US010519556B2

(12) United States Patent
Nie et al.

(10) Patent No.: US 10,519,556 B2
(45) Date of Patent: Dec. 31, 2019

(54) PROCESS FOR RECYCLING WASTE CARBIDE

(71) Applicant: BEIJING UNIVERSITY OF TECHNOLOGY, Beijing (CN)

(72) Inventors: Zuoren Nie, Beijing (CN); Xiaoli Xi, Beijing (CN)

(73) Assignee: BEIJING UNIVERSITY OF TECHNOLOGY, Beijing (CN)

( * ) Notice: Subject to any disclaimer, the term of this patent is extended or adjusted under 35 U.S.C. 154(b) by 303 days.

(21) Appl. No.: 14/908,495

(22) PCT Filed: Jul. 30, 2014

(86) PCT No.: PCT/CN2014/083316
§ 371 (c)(1),
(2) Date: Jan. 28, 2016

(87) PCT Pub. No.: WO2015/192443
PCT Pub. Date: Dec. 23, 2015

(65) Prior Publication Data

US 2016/0208398 A1 Jul. 21, 2016

(30) Foreign Application Priority Data

Jun. 17, 2014 (CN) ..... 2014 1 0269955

(51) Int. Cl.
*C25C 3/34* (2006.01)
*C25C 7/00* (2006.01)

(52) U.S. Cl.
CPC ..... *C25C 3/34* (2013.01); *C25C 7/005* (2013.01)

(58) Field of Classification Search
CPC ..... C25C 3/34; C25C 7/005
See application file for complete search history.

(56) References Cited

U.S. PATENT DOCUMENTS 2,722,509 A * 11/1955 Wainer ..... C25C 3/28 204/291
2,731,402 A * 1/1956 Topinka ..... C25C 5/04 205/401

(Continued)

FOREIGN PATENT DOCUMENTS

| | | |
|---|---|---|
| CN | 102127778 A | 7/2011 |
| CN | 103773959 A | 5/2014 |
| JP | 54-001202 | 1/1979 |

OTHER PUBLICATIONS

Edtmaier, et al., "Selective removal of the cobalt binder in WC/Co based hardmetal scraps by acetic acid leaching," Hydrometallurgy, 2005, vol. 76, pp. 63-71.

(Continued)

*Primary Examiner* — Ciel P Thomas
(74) *Attorney, Agent, or Firm* — Morgan, Lewis & Bockius LLP

(57) ABSTRACT

The present invention provides a process for recycling waste carbide, wherein the waste carbide is directly used as anode and electrolyzed in the molten salt, comprising the following steps: 1) the vacuum dehydrating of the molten salt electrolyte; 2) electrolyzing the waste carbide, which is used as anode, and an inert electrode, which is used as cathode in the molten salt electrolyte with the electrolysis temperature of 350~1000° C.; 3) separating and collecting the metal powder obtained by electrolysis from molten salt medium. According to the technical solutions of the present invention, tungsten and cobalt ions can be dissolved from the anode material-waste carbide directly into the molten salt medium and deposited on the cathode plate with being driven by the electrolysis voltage, to obtain the metal powder particles. The tungsten, cobalt and other products obtained by electrolysis can be used as carbide materials, high temperature structural materials, weapons materials, (Continued)

photocatalytic materials, etc., and can be applied to the fields of processing production, aerospace, military industry, environment and energy, and the like. This method has a short process, has no solid/liquid/gas waste emissions, and is environment-friendly.

2 Claims, 4 Drawing Sheets

(56) References Cited

U.S. PATENT DOCUMENTS

| | | | | |
|---|---|---|---|---|
| 2,923,672 | A * | 2/1960 | Ervin, Jr. | C22B 34/30 204/246 |
| 5,384,016 | A | 1/1995 | Un et al. | |
| 5,951,844 | A * | 9/1999 | Jansen | C25C 7/06 204/228.1 |
| 2014/0291161 | A1* | 10/2014 | Awazu | C25C 3/34 205/348 |

OTHER PUBLICATIONS

Erdogan, et al., "Electrochemical Reduction of Tungsten Compounds to Produce Tungsten Power," Metallurgical and Materials Transactions, Aug. 2010, vol. 41B, pp. 798-804.

Gurmen, et al., "Recovery of Cobalt Powder and Tungsten Carbide from Cemented Carbide Scrap—Part I: Kinetics of Cobalt and Acid Leaching," <http://www.metallurgie.rwth-aachen.de/new/images/pages/publikationen/co_i_erzmetall_id_4455.pdf>.

Kojima, et al., "Recycling process of WC-Co cermets by hydrothermal treatment," 2005, Journal of Materials Science, vol. 40, pp. 5167-5172.

Lin, et al., "Selective dissolution of the cobalt binder from scraps of cemented tungsten carbide in acids containing additives," Hydrometallurgy, 1996, vol. 43, pp. 47-61.

Liu, et al., "Electro-deposition tangsten coating on low activation steel substrates from $Na_2WO_4$—ZnO—$WO_3$ melt salt," Rare Metals, Aug. 2012, vol. 31, No. 4, pp. 350-354.

Wang, et al., "Electrolysis of solid metal sulfide to metal and sulfur in molten NaCl-KCl," Electrochemistry Communications, 2011, vol. 13, pp. 1492-1495.

* cited by examiner

PROCESS FOR RECYCLING WASTE CARBIDE

TECHNICAL FIELD

The present invention belongs to the field of metallurgy, in particular relates to a method for recovering metals from waste carbide.

BACKGROUND TECHNOLOGY

Carbide is a powder metallurgy product which is sintered in a vacuum furnace or a hydrogen reduction furnace with tungsten carbide powder as main component and cobalt or nickel as binder.

There is a shortage of cobalt resources in our country, and a large quantity of cobalt need to be imported every year. Although tungsten resources are abundant, with the significant increase in production in recent years, reserves and exploitation capacities thereof are reducing. Waste carbide contains up to 40% to 95% of tungsten, much higher than that in APT as raw material for production of carbide, and is of a very high value in use. Therefore, recycling of waste carbide is of great significance to rationally use and protection of existing resources and improvement in resource utilization. Currently, the technologies for recycling of waste carbide include: acid leaching method[1], zinc melting method[2], mechanical crushing method[3] and selective electrochemical dissolution method[4].

Acid leaching recycling process is relatively simple, but NO and $SO_2$ gases discharged during the reaction process, causing serious harm to the environment, and the equipment requires corrosion protection, and safety operation should be guaranteed. Zinc melting method is widely used, but the method has some disadvantages, such as zinc residue, high energy consumption, complex equipment, etc. Mechanical crushing method requires strong crushing and abrasive equipment in practice because it is difficult to break carbide scrap. Furthermore, the oxidation of materials during crushing and milling process could easily lead to changes in mix ingredients, thus it is difficult to recycle high-quality alloy. In selective electrochemical dissolution process, waste carbide, which is used as anode, is put into an electrolysis cell with acid as electrolyte for electrolysis. Cobalt in the alloy becomes cobalt ions and enters the solution, and tungsten carbide which has lost cobalt as cohesive metal becomes loose alloy. Then cobalt powder can be prepared by precipitating cobalt-containing solution with ammonium oxalate, then calcining and reducing the resultant precipitates. Tungsten carbide can be used in carbide production after appropriate treatment, such as ball milling and breaking. Recovery of waste carbide by electrochemical dissolution process is simple in technology, but there will be an anode passivation, which makes the current efficiency greatly reduced, and the subsequent processing of the waste liquor generated during the electrolysis increases recovery cost.

Molten salt electrolysis process obtains the pure metal or alloy product of tungsten on the working electrode in the electrolyte of molten salt by electrochemical method. In the trend that short process, low cost and friendly to environment are required in the development of the metallurgical industry, molten salt electrolysis process is very interesting because of its unique advantages in respect of the manufacture of metals and their alloys, for example, small footprint of equipment, simple operation process and minor side effects to the environment, etc.

Liu[5] adopted the $Na_2WO_4$—ZnO—$WO_3$ system to prepare tungsten coating by molten salt electrolysis using tungsten plate as anode. The particle size of the resulting product is about 3 μm, and zinc is also easily deposited when tungsten is deposited, rendering the product impure. Erdoğan[6] prepared tungsten powder by electrolysis reduction in $CaCl_2$—NaCl molten salt system under argon atmosphere, using graphite rod and $CaWO_4$ as anode and cathode respectively, with the particle size of obtained tungsten powder approaching 100 nm. Wang[7] prepared nanometer tungsten powder in NaCl—KCl molten salt system under argon atmosphere, using graphite rod and $WS_2$ block as anode and cathode respectively, with the particle size of the product of 50-100 nm and the current efficiency of 94%. Wang, et al. adopted the $CaCl_2$—NaCl—$Na_2WO_4$ system to directly prepare tungsten powder by fusion electrolysis using graphite rod as anode. Although the traditional tungsten-manufacturing process was shortened, the particle size of the resulting tungsten powder is relatively large with an average particle size of about 2 μm, which does not meet the nanoscale. Moreover, some impurities such as C, WC, $W_2C$ and the like appeared in the cathode product, and it is difficult to separate them by subsequent process.

From the above findings, most of the studies relating to preparing nanometer tungsten powders by molten salt electrolysis focused on the electrolysis of tungsten-containing actives. Compared to using tungsten-containing actives to prepare tungsten powder, electrolyzing waste carbide using molten salt to prepare nanometer tungsten powder has lower material cost; on the other hand, the key technology for this lies in the dissolution of tungsten in anode carbide, and effective isolation of tungsten from activated carbon atoms during electrolysis process.

Currently the prior technology for recycling waste carbide has shortcomings, such as long production process, large energy consumption, unfriendly to environment, product defects, etc. Therefore, it is very necessary to find out a recycling technology with short process, high efficiency and quality for recovering waste carbide. The method with waste carbide directly as anode and adopting molten salt electrolysis to obtain nanometer tungsten powder recovered on the cathode has not yet been reported. This method may greatly shorten the existing waste carbide recycling process without waste emission, and it is friendly to environment and has low energy consumption. Furthermore, the recycled tungsten powder may have a particle size of nanoscale.

CITED REFERENCES

[1] T. Kojima, T. Shimizu, R. Sasai, et al. Recycling process of WC—Co cermets by hydrothermal treatment. Journal of materials science, 2005, 40(19): 5167-5172.

[2] S. Gurmen, FRIEDRICH B. Friedrich. Recovery of cobalt powder and tungsten carbide from cemented carbide scrap-Part I: Kinetics of cobalt acid leaching. Erzmetall, 2004, 57(143-147).

[3] C. Edtmaier, R. Schiesser, MEISSL C. Meissl, et al. Selective removal of the cobalt binder in WC/Co based hard metal scraps by acetic acid leaching. Hydrometallurgy, 2005, 76(1): 63-71.

[4] J. C. Lin, J. Y. Lin, S. P. Jou. Selective dissolution of the cobalt binder from scraps of cemented tungsten carbide in acids containing additives. Hydrometallurgy, 1996, 43(1): 47-61.

[5] Y. Liu, Y. Zhang, Q. Liu, et al. Electro-deposition tungsten coating on low activation steel substrates from $Na_2WO_4$—ZnO—$WO_3$ melt salt. Rare Metals, 2012, 31(4): 350-354.

[6] M. Erdoğan, İ. Karakaya. Electrochemical reduction of tungsten compounds to produce tungsten powder. Metallurgical and Materials Transactions B, 2010, 41(4): 798-804.

[7] T. Wang, H. P. Gao, X. B. Jin. Electrolysis of solid metal sulfide to metal and sulfur in molten NaCl—KCl. Electrochemistry Communications, 2011, 13(12): 1492-1495.

DESCRIPTION OF THE INVENTION

The purpose of the present invention is to provide a method of recycling waste carbide with respect to the shortcomings presently existing in the prior art.

The technical solution for achieving the above purpose of the present invention is A process for recycling waste carbide, wherein waste carbide is directly used as anode and electrolyzed in molten salt, said carbide may be tungsten-cobalt carbides, for example YG3, YG6, YG8, YG10, YG16, YG20; tungsten-titanium-cobalt carbides, for example YT 15; and tungsten-titanium-tantalum(niobium) carbides.

The process specifically comprises the following steps:

1) the vacuum dehydrating of the molten salt electrolyte; wherein the composition of said molten salt electrolyte is (x)A-(y)B-(z)NaCl, wherein x is the mole percentage content of A, y is the mole percentage content of B, z is the mole percentage content of NaCl; x is in the range of 5~70 mol %, y is in the range of 0~60 mol %, z is in the range of 0~50 mol %; said A is one or more of $CaCl_2$, KCl and LiCl, said B is one or more of $WCl_6$, $WCl_4$, $WCl_2$, $Na_2WO_4$, $K_2WO_4$, and $CaWO_4$;

2) electrolyzing waste carbide, which is used as anode, and an inert electrode, which is used as cathode, in the molten salt electrolyte with the electrolysis temperature of 350~1000° C.;

3) separating and collecting the resultant metal powder obtained by electrolysis from molten salt medium.

Wherein in said step 2), titanium plate, stainless steel plate, carbon plate, or graphite carbon is used as the cathode. A spacing between the anode and the cathode is 5~350 mm.

Wherein in said step 2), the electrolysis way is galvanostatic electrolysis, and the current density is controlled in 0.02~1.0 A/cm$^2$; or the electrolysis way is potentiostatic electrolysis, and the cell voltage is controlled in 1.0~10 V.

Preferably the temperature for the electrolysis is 500-780° C.

Furthermore, by controlling the voltage and the protective gas during the electrolysis, the types of product can be correspondingly controlled.

In particular, in said step 2), a protective gas is used during the electrolysis, the protective gas is a mixed gas of one or more of oxygen, air, nitrogen and argon for W, W—Co powder products, and the volume content of oxygen in the mixed gas is 10-20%, and the cell voltage is controlled in 2.8~3.2 V during potentiostatic electrolysis. As an alternative, in said step 2), a non-oxidizing gas is used as protective gas during the electrolysis for WC powder product, the non-oxidizing gas is nitrogen or argon, wherein, the electrolysis way is galvanostatic electrolysis, the cell voltage is kept constant in 1.0~3.0 V by controlling the current intensity during the electrolysis.

Alternatively, in said step 2), a mixed gas containing oxygen is used for W, W—Co powder products, and the volume ratio of oxygen in the mixed gas is 10-20%, other gas in the mixed gas is nitrogen or argon, wherein the electrolysis way is galvanostatic electrolysis, and the cell voltage is kept constant in 1.0~3.0 V by controlling the current intensity during the electrolysis.

Wherein, in said step 3), pickling, washing, filtrating and vacuum drying are used to separate powder products from the molten salt medium. Further, the vacuum condition can be set to a vacuum degree of 0.1-2.0 MPa, and the drying temperature is 20-50° C. during the vacuum drying.

The benefic effects of the present invention lie in:

According to the technical solutions of the present invention, tungsten and cobalt ions can be dissolved from the anode material-waste carbide directly into the molten salt medium and deposited on the cathode plate with being driven by the electrolysis voltage, to obtain the metal powder particles. This method can continuously treat waste carbide materials by electrolysis, and directly obtain elementary substances such as tungsten, cobalt and the like, or composite nano-powder materials by controlling the electrolysis conditions. The tungsten, cobalt and other products obtained by electrolysis can be used as raw materials of carbide materials, high temperature structural materials, weapons materials, photocatalytic materials, etc., and applied to the fields of processing production, aerospace, military industry, environment and energy, and the like. This method has a short process, has no solid/liquid/gas waste emissions, and is environment-friendly.

The tungsten metal powders obtained by electrolysis according to the method of recycling waste carbide to prepare nanometer tungsten powders by molten salt electrolysis, as proposed in the present application, may be nanoscale and micron sized powders, and the particle size of the powders is in the range of 20 nm~500 μm. This method can also be used to recycle other refractory metal alloys (super density alloys, etc.), directly prepare elemental metal materials, high-temperature structural materials, carbide materials and high density alloy materials, etc.

Figure 1:
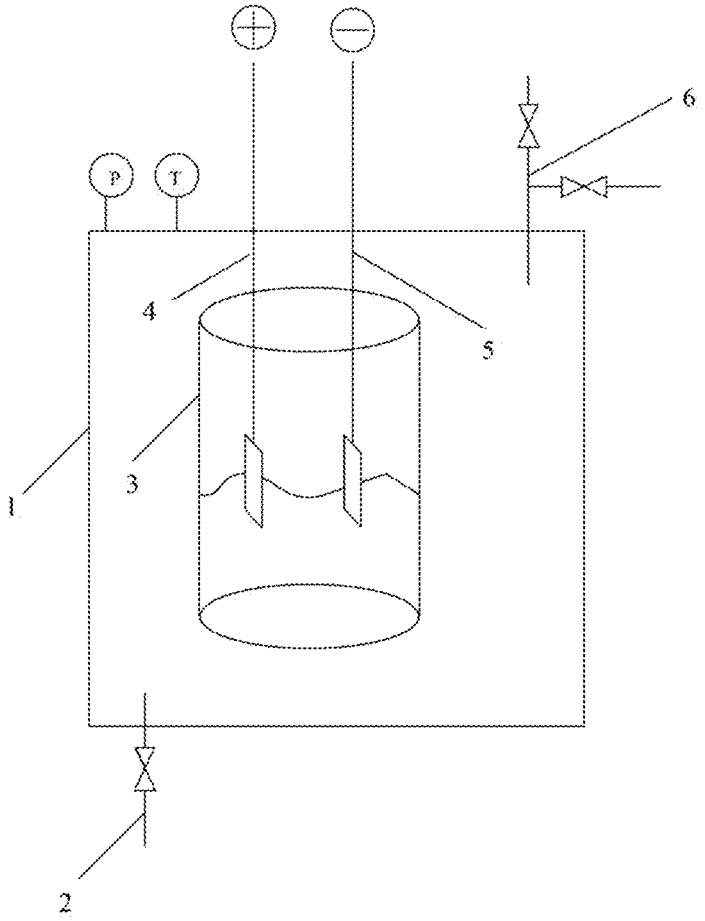
FIG. 1 is the schematic view of the electrolytic cell structure of the invention.

In the figures: 1. sealed container, 2. air outlet, 3. electrolytic cell, 4. anode, 5. cathode, 6. air inlet.

EXAMPLES

The present invention will be described by the following preferred embodiments. The skilled artisan should know that the examples are used only to illustrate the invention and are not intended to limit the scope of the invention.

In the embodiments, unless otherwise specified, all the means used are conventional means in the art.

In the present invention, the conventional apparatus in the art may be employed for electrolysis. The following examples employ the device shown in FIG. 1: electrolytic cell 3 is placed in a sealed container 1, the sealed container provides protective gas and electric heating. Container 1 is provided with a pressure detecting device P, a temperature detecting device T, an air inlet 6, an air outlet 2. An anode 4 and a cathode 5 are submerged into the electrolytic cell.

Example 1

The method of preparing tungsten nano-powders by molten salt electrolysis to recycle waste carbide was used in the example. The electrolytic cell was protected with 10% oxygen+argon (by volume ratio). The molten salt system consisted of NaCl-52 mol % $CaCl_2$ and the electrolysis temperature was 750° C. The titanium plate was used as cathode, and YG6 waste carbide was used as anode material with an electrode distance of 3 cm, the potentiostatic electrolysis was performed with a cell voltage of 3.2V, and the cell current during the electrolysis maintained constant at 1.3 A. As the anode material consumed, the cell current increased. The electrolysis was continued for 8 hours. The deposited metal powders after electrolysis were separated from the molten salt medium and collected by the methods of pickling, washing, filtrating and vacuum drying. The vacuum degree was 0.5 MPa, and the drying temperature was 50° C.

Figure 2:
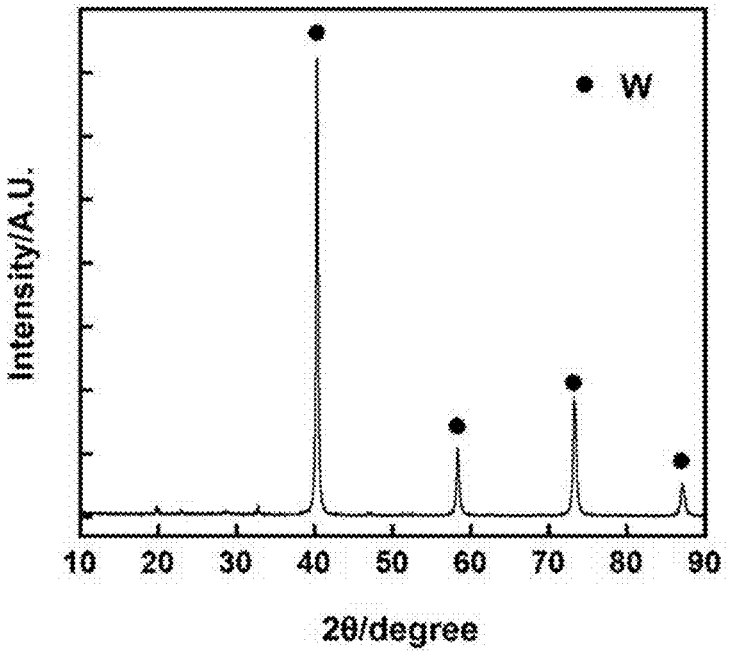
FIG. 2 is the XRD pattern of the powder products obtained by electrolysis of YG6 waste carbide anode materials of in Example 1.
Figure 3:
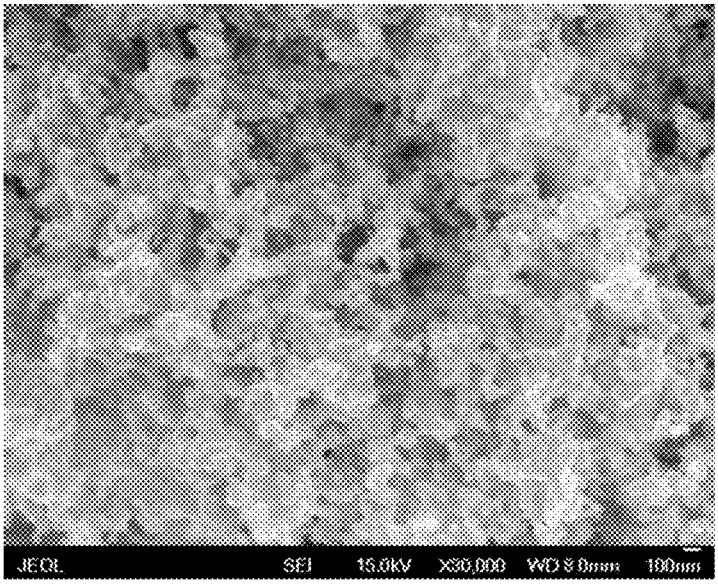
FIG. 3 is the FESEM photo of the powder products obtained by electrolysis of YG6 waste carbide anode materials in Example 1.

The purity of the tungsten metal powders obtained by electrolysis reached 98.2 wt %, and the morphology of the metal tungsten powder was agglomerated spherical particles with size distribution in the range of 40~400 nm. The XRD and FESEM results of the tungsten metal powders obtained by electrolysis were shown in FIG. 1 and FIG. 2, respectively. FIG. 1 shows the XRD pattern of the obtained powder products; FIG. 2 is the FESEM photo of the obtained powder products with 30,000 times magnification.

Example 2

A method of directly recycling WC powders by molten salt electrolysis of waste WC carbide was used in the example. The electrolytic cell was protected with argon gas. The molten salt system consisted of NaCl-50 mol % KCl, and the electrolysis temperature was 750° C. The graphite carbon was used as cathode, and WC was used as anode material with an electrode distance of 3 cm. Galvanostatic electrolysis was carried out with a current density of 0.3 $A/cm^2$. The cell voltage during the electrolysis remained at 2.2 V. The resulting metal powders after electrolysis was separated from the molten salt medium and collected by the methods of pickling, washing, filtrating and vacuum drying. The vacuum degree was 0.5 MPa, and the drying temperature was 50° C.

Figure 4:
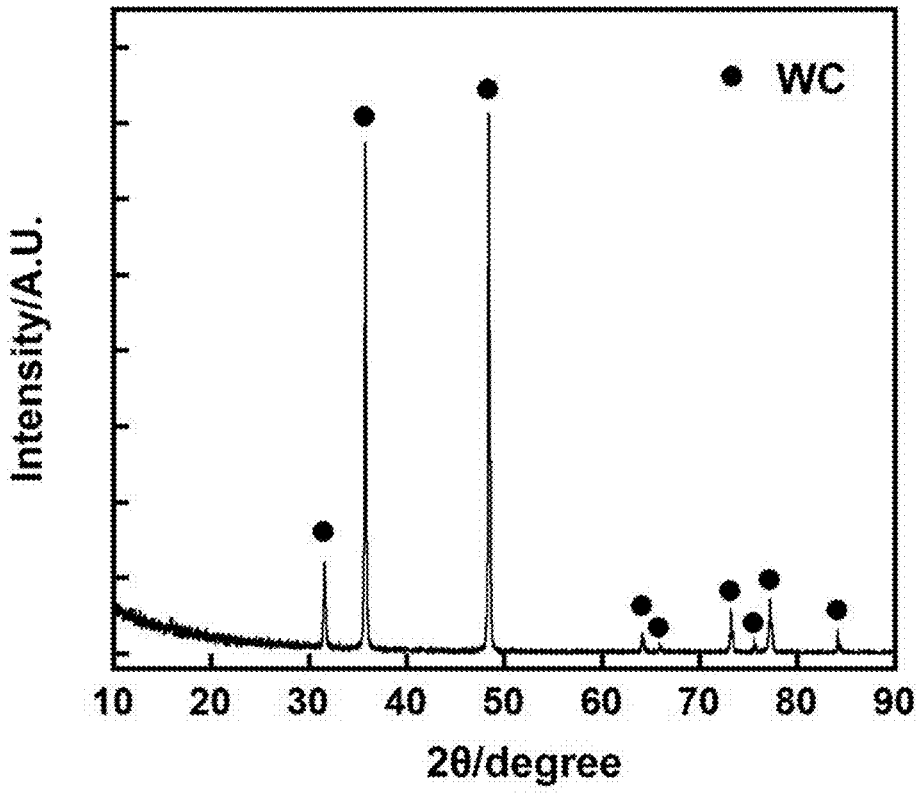
FIG. 4 is the XRD pattern of the powder products obtained by electrolysis of waste WC in Example 2.
Figure 5:
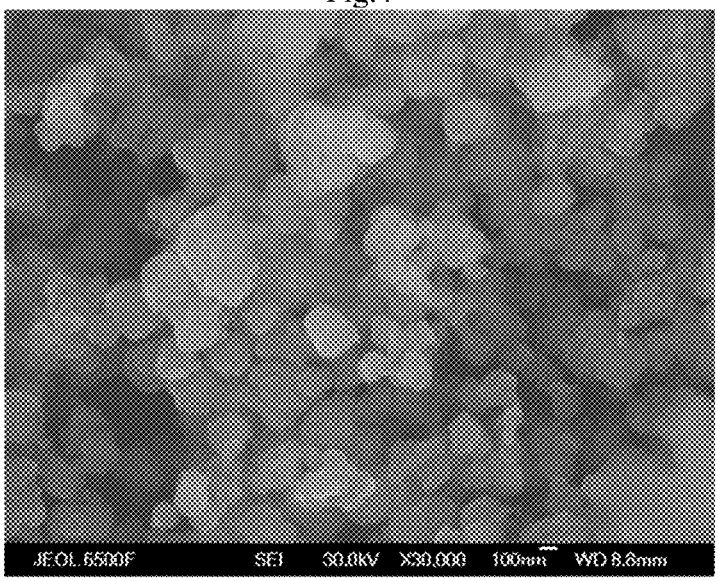
FIG. 5 is the FESEM photo of the powder products obtained by electrolysis of waste WC in Example 2.

The purity of the WC powder particles obtained by electrolysis reached 99.1 wt %. The XRD graph and FESEM photo of the product are shown in FIG. 4 and FIG. 5, respectively.

Example 3

A method of directly preparing tungsten-cobalt alloy powders by molten salt electrolysis of waste carbide was used in the example. The electrolytic cell was protected with 20% oxygen+argon. The molten salt system consisted of NaCl-50 mol % $Na_2WO_4$-26 mol % $CaCl_2$, and the electrolysis temperature was 750° C. The titanium plate was used as cathode, and YG16 waste carbide was used as anode material with an electrode spacing of 3 cm. Galvanostatic electrolysis was employed with a current density of 0.5 $A/cm^2$, and the cell voltage during the electrolysis kept constant at 2.9 V. W—Co composite powder particles were obtained by electrolysis. The resulting metal powders after electrolysis were separated from the molten salt medium and collected by the methods of pickling, washing, filtrating and vacuum drying. The vacuum degree was 0.5 MPa, and the drying temperature was 40° C.

Figure 6:
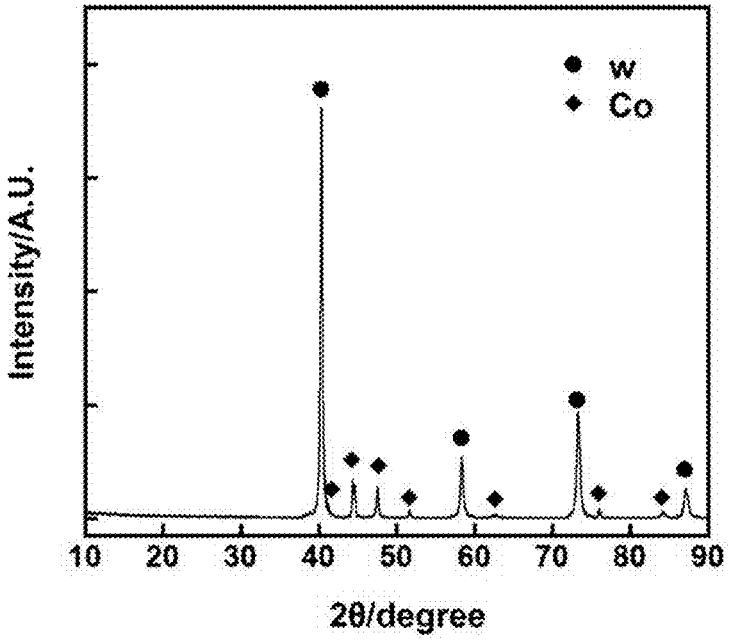
FIG. 6 is the XRD pattern of the powder products obtained by electrolysis of YG16 waste carbide anode materials in Example 3.
Figure 7:
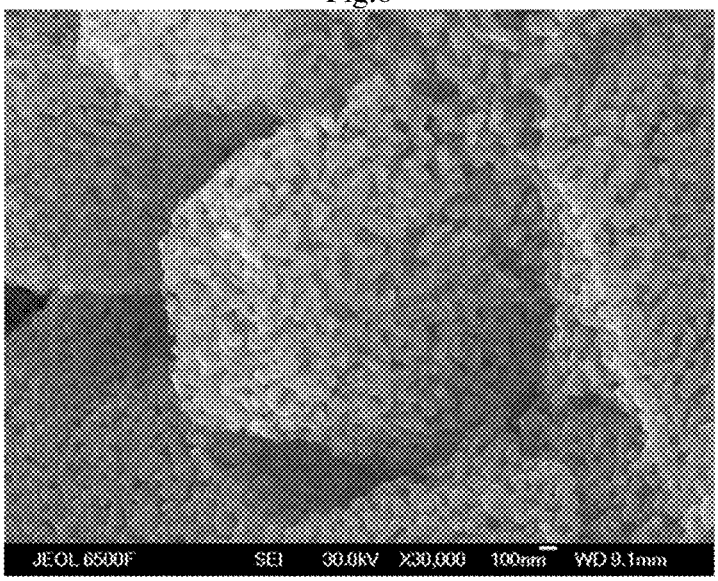
FIG. 7 is the FESEM photo of the powder products obtained by electrolysis of YG16 waste carbide anode materials of in Example 3.

The XRD graph and FESEM photo of the product are shown in FIG. 6 and FIG. 7, respectively.

Example 4

A method of directly preparing tungsten powders by molten salt electrolysis to treat waste carbide was used in the example. The electrolytic cell was protected with 20% oxygen+argon. The molten salt system consisted of LiCl-5 mol % NaCl-10 mol % $Na_2WO_4$-36 mol % $CaCl_2$, and the electrolysis temperature was 500° C. The stainless steel plate was used as cathode, YG3 waste carbide of was used as anode material with an electrode spacing of 3 cm. Galvanostatic electrolysis was used with a current density of 0.05 $A/cm^2$, and the cell voltage during the electrolysis kept constant at 1.2 V. The resulting metal powders after electrolysis were separated from the molten salt medium and collected by the methods of pickling, washing, filtrating and vacuum drying. The vacuum degree was 0.5 MPa, and the drying temperature was 40° C.

Tungsten metal nano-particles were obtained by electrolysis, the purity of which reached 99.3 wt %.

Example 5

A method of directly recycling WC nano-powders by molten salt electrolysis of waste YG10 carbide was used in the example. The electrolytic cell was protected with nitrogen. The molten salt system consisted of NaCl-4 mol % $WCl_2$-40 mol % KCl, and the electrolysis temperature was 780° C. The carbon plate was used as cathode, and WC was used as anode material with an electrode distance of 3 cm. Galvanostatic electrolysis was used with a current density of 0.3 $A/cm^2$, and the cell voltage during the electrolysis kept constant at 2.2 V. The resulting metal powders after electrolysis were separated from the molten salt medium and collected by the methods of pickling, washing, filtrating and vacuum drying. The vacuum degree was 0.5 MPa, and the drying temperature was 50° C.

WC powder particles were obtained by electrolysis, the purity of which reached 98.1 wt %.

Example 6

A method of directly preparing tungsten powders by molten salt electrolysis of waste carbide was used in the example. The electrolytic cell was protected with 10% oxygen+argon. The molten salt system consisted of LiCl-10 mol % NaCl-5 mol % $Na_2WO_4$-36 mol % $CaCl_2$, and the electrolysis temperature was 500° C. The stainless steel plate was used as cathode, and waste YG3 carbide was used as anode material with an electrode distance of 3 cm. Galvanostatic electrolysis was used with a current density of 0.1

A/cm$^2$, and the cell voltage during the electrolysis kept constant at 1.6 V. The resulting metal powders after electrolysis were separated from the molten salt medium and collected by the methods of pickling, washing, filtrating and vacuum drying. The vacuum degree was 0.5 MPa, and the drying temperature was 50° C.

Tungsten metal nano-particles were obtained by electrolysis, the purity of which reached 99.3 wt %.

Example 7

A method of directly preparing tungsten powders by molten salt electrolysis of waste carbide was used in the example. The electrolytic cell was protected with 10% oxygen+argon. The molten salt system consisted of LiCl-26 mol % KCl-5 mol % $Na_2WO_4$-10 mol % $CaCl_2$, and the electrolysis temperature was 500° C. The stainless steel plate was used as cathode, and waste YG3 carbide of was used as anode material with an electrode distance of 3 cm. Galvanostatic electrolysis was used with a current density of 0.08 A/cm$^2$, and the cell voltage during the electrolysis kept constant at 1.4 V. The resulting metal powders from electrolysis were separated from the molten salt medium and collected by the methods of pickling, washing, filtrating and vacuum drying. The vacuum degree was 0.5 MPa, and the drying temperature was 50° C.

Tungsten metal nano-particles were obtained by electrolysis, the purity of which reached 98.7 wt %.

The embodiments described above are merely preferred embodiments of the present invention, but not intended to limit the scope of the invention. Those skilled in the art may make various modifications and improvements to the technical solutions of the present invention without departing from the designing spirit, which all fall within the protection scope defined by the appended claims of the invention.

INDUSTRIAL APPLICABILITY

The present invention discloses a process for recycling waste carbide, wherein the waste carbide is directly used as anode and electrolyzed in the molten salt, comprising the following steps: 1) the vacuum dehydrating of the molten salt electrolyte; 2) electrolyzing waste carbide, which is used as anode, and an inert electrode, which is used as cathode, in the molten salt electrolyte with the electrolysis temperature of 350~1000° C.; 3) separating and collecting the metal powder obtained by electrolysis from molten salt medium. According to the technical solutions of the present invention, tungsten and cobalt ions can be directly dissolved from the anode material-waste carbide into the molten salt medium and deposited on the cathode plate with being driven by the electrolysis voltage, to obtain the metal powder particles. This method has a short process, has no solid/liquid/gas waste emissions, and is environment-friendly. The tungsten, cobalt and other products obtained by electrolysis can be used as carbide materials, high temperature structural materials, weapons materials, photocatalytic materials, etc., have a wide application field, and have an important effect in the fields of processing production, aerospace, military industry, environment and energy, and the like.

What is claimed is:

1. An electrolytic process for recycling waste carbide, characterized in that, the waste carbide is directly used as an anode and electrolyzed in a molten salt electrolyte, comprising the following steps, without solid, liquid or gas waste emissions:

1) vacuum dehydrating the molten salt electrolyte; wherein the molten salt electrolyte is a compound of formula:

(x)A-(y)B—(z)NaCl wherein, x is the mole percentage content of A;

y is the mole percentage content of B;

z is the mole percentage content of NaCl;

x is in the range of 5 to 70 mol %;

y is in the range of 0 to 60 mol %;

z is in the range of 0 to 50 mol %;

A is one or more selected from the group consisting of $CaCl_2$), KCl and LiCl; and B is one or more selected from the group consisting of $WCl_6$, $WCl_4$, $WCl_2$, $Na_2WO_4$, $K_2WO_4$ and $CaWO_4$;

2) electrolyzing the waste carbide in the molten salt electrolyte via electrolysis having an electrolysis temperature of 350 to 1000° C., whereby a metal powder having a particle size in the range of 20 nm-500 μm is produced, wherein the waste carbide is used as the anode in the electrolysis, and an inert electrode is used as a cathode in the electrolysis, wherein the anode and the cathode are submerged into the molten salt electrolyte, vertically parallel to one another, with a distance of at least 2 cm apart, and wherein the anode and the cathode do not overlap or intersect each other;

wherein a protective gas is used during the electrolysis, wherein the protective gas is a mixed gas comprising one or more gases selected from the group consisting of oxygen, air, nitrogen and argon for W, W—Co powder products, wherein the mixed gas comprises a volume content of oxygen in the range of 10-20%, and wherein the electrolysis comprises potentiostatic electrolysis in a cell having a cell voltage, and the cell voltage is controlled in the range of 2.8 to 3.2 V; and 3) separating and collecting the metal powder produced by the electrolysis from the molten salt electrolyte.

2. The process according to claim 1, wherein the cathode is selected from the group consisting of a titanium plate, a stainless steel plate, a carbon plate, and a graphite carbon.

* * * * *